US006811717B2

(12) United States Patent
Iyengar et al.

(10) Patent No.: US 6,811,717 B2
(45) Date of Patent: Nov. 2, 2004

(54) MAGNETORHEOLOGICAL COMPOSITIONS FOR USE IN MAGNETORHEOLOGICAL FLUIDS AND METHOD OF PREPARING SAME

(75) Inventors: Vardarajan R. Iyengar, Macomb, MI (US); Robert Thomas Foister, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/209,176

(22) Filed: Jul. 31, 2002

(65) Prior Publication Data

US 2003/0047705 A1 Mar. 13, 2003

Related U.S. Application Data

(63) Continuation-in-part of application No. 09/751,139, filed on Dec. 29, 2000, now abandoned.

(60) Provisional application No. 60/173,793, filed on Dec. 30, 1999.

(51) Int. Cl.[7] ..... H01F 1/22

(52) U.S. Cl. ..... 252/62.52; 252/62.55; 252/62.54

(58) Field of Search ..... 252/62.54, 62.55; 428/403; 427/216; 106/401, 403

(56) References Cited

U.S. PATENT DOCUMENTS

| | | | | |
|---|---|---|---|---|
| 5,143,637 A | * | 9/1992 | Yokouchi et al. | 252/62.52 |
| 6,149,832 A | * | 11/2000 | Foister | 252/62.52 |
| 6,451,219 B1 | | 9/2002 | Iyengar et al. | |
| 6,547,983 B2 | | 4/2003 | Iyengar | |
| 6,592,772 B2 | | 7/2003 | Foister et al. | |
| 6,599,439 B2 | | 7/2003 | Iyengar et al. | |
| 6,638,443 B2 | | 10/2003 | Iyengar et al. | |

* cited by examiner

*Primary Examiner*—C. Melissa Koslow
(74) *Attorney, Agent, or Firm*—Michael D. Smith

(57) ABSTRACT

The subject invention provides a magnetorheological (MR) composition having improved resistance to oxidation and increased dispersability in a carrier fluid. The composition includes a plurality of metal particles and a surfactant including a hydrocarbon with at least one of a hydroxyl, a carbonyl, and an amine group bonded to the hydrocarbon for reacting with the metal particles. The surfactant is present in an amount such that from about 1% to about 20% of the amount of the surfactant is adsorbed to the metal particles. The surfactant is reacted with the metal particles such that about 75% to about 100% of a maximum amount of the surfactant adsorbs to the metal particles for improving the resistance of the metal particles to oxidation and for increasing the dispersability of the magnetorheological composition in the carrier fluid. The MR composition according to the subject invention is utilized in a magnetorheological (MR) fluid.

44 Claims, 4 Drawing Sheets

MAGNETORHEOLOGICAL COMPOSITIONS FOR USE IN MAGNETORHEOLOGICAL FLUIDS AND METHOD OF PREPARING SAME

RELATED APPLICATIONS

This is a continuation-in-part of U.S. patent application Ser. No. 09/751,139 filled Dec. 29, 2000 now abandoned, which claims benefit of U.S. Provisional Application Ser. No. 60/173,793 filled Dec. 30, 1999.

FIELD OF THE INVENTION

The subject invention relates to a magnetorheological (MR) composition for use in a magnetorheological (MR) fluid and a method of preparing the same.

BACKGROUND OF THE INVENTION

The related art provides a magnetorheological (MR) composition including a plurality of metal particles for use in a magnetorheological (MR) fluid. These MR fluids are formulated by dispersing the metal particles in a hydrocarbon carrier fluid. Anti-settling, anti-friction and anti-wear agents may be added to the carrier fluid. A surfactant may also be added to the carrier fluid following dispersion of the metal particles for "in situ" surface treatment of the metal particles. In order to assure a desirable amount of the surfactant has reacted with the metal particles in the mixture, a large excess of the surfactant must be added. Since it is usually impractical, if not impossible, to remove, the excess, non-adsorbed surfactant remains in the mixture.

One such MR fluid, shown in U.S. Pat. No. 6,149,832 to Foister, discloses the surfactant bonded to the metal particles. However, the '832 patent does not disclose optimizing the amount of surfactant adsorbed to the metal particles for optimal MR fluid performance. Also, the '832 patent does not disclose the MR fluid having the non-adsorbed surfactant removed from the MR fluid. Another MR fluid, shown in U.S. Pat. No. 5,143,637 to Yokouchi et al., discloses the surfactant having a lipophilic group bonded to the metal particles. However, the '637 patent does not optimize the MR composition for optimal MR fluid performance nor remove the non-adsorbed surfactant prior to formulating the MR fluid.

Excess surfactant, however, is known to counteract the effect of thickeners, such as fumed silica, used to stabilize MR fluids against particle settling. While it is recognized that a certain amount of surfactant is beneficial in promoting particle dispersion, excess surfactant de-stabilizes the mixture, thereby counteracting the action of the thickener.

The metal particles suitable for use as the solid phase of the MR fluids are selected for their ability to perform as "soft" magnetizable materials. In the context of MR fluids, this means that the solid metal particle can be magnetized to exhibit a high-induced magnetic moment under a given magnetic field, but that the magnetic moment will relax, with little or no hysteresis, when the field is removed. This magnetic property is primarily dependent upon the metal particles selected for use and their chemistry and microstructure immediately prior to formulation into the MR fluids. Proper selection of suitable metallic particles and careful handling of those particles prior to formulation are therefore important in limiting the impact of processing and environmental conditions on the particles.

Metal particles typically used in the MR fluids are available in powder form. The powder is stored under atmospheric conditions until used. For safety and economic reasons, it is not practical to maintain the powders under inert atmospheres. Most powders used in MR fluids are oxidized to some degree prior to formulation. Furthermore, due to the finely divided character of the powder, oxidation tends to affect a large surface area. The practical effect of this oxidation is to change the surface chemistry of the metal particles and degrade their saturation magnetization. This, in turn, impacts upon the strength and quality of the magnetic moment that can be created in a given MR fluid under a magnetic field.

Accordingly, it would be advantageous to provide a MR composition for use in a MR fluid having improved resistance to oxidation and increased dispersability to improve the performance of the MR fluid.

BRIEF SUMMARY OF THE INVENTION AND ADVANTAGES

The subject invention provides a magnetorheological (MR) composition having improved resistance to oxidation and increased dispersability in a carrier fluid. The composition includes a plurality of metal particles and a surfactant including a hydrocarbon with at least one of a hydroxyl, a carbonyl, and an amine group bonded to the hydrocarbon for reacting with the metal particles. The surfactant is present in an amount such that from about 1% to about 20% of the amount of the surfactant is adsorbed to the metal particles for improving the resistance of the metal particles to oxidation and for increasing the dispersability of the magnetorheological composition in the carrier fluid.

The subject invention further provides a method of preparing the MR composition. The method includes the step of reacting the metal particles with the surfactant until about 75% to about 100% of the maximum amount of the surfactant adsorbs to the metal particles. The MR composition, according to the subject invention, is utilized in a magnetorheological (MR) fluid. The MR fluid has improved stability due to the MR composition having about 75% to about 100% of the maximum amount of the surfactant adsorbed to the metal particles.

Accordingly, it has been determined that treating the surface of the metal particles prior to formulation into the MR fluid substantially improves the performance of the MR fluid and limits oxidation of the metal particles. Further, the subject invention has the added advantage of reducing the necessity for special handling of the metal particles that pose an explosive risk. The metal particles exhibit improved dispersion properties such that no addition of surfactant to the MR fluid mixture is required while exhibiting superior stability. MR fluids prepared with the MR composition are stabilized against particle oxidation and magnetic degradation typical of currently available MR compositions.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
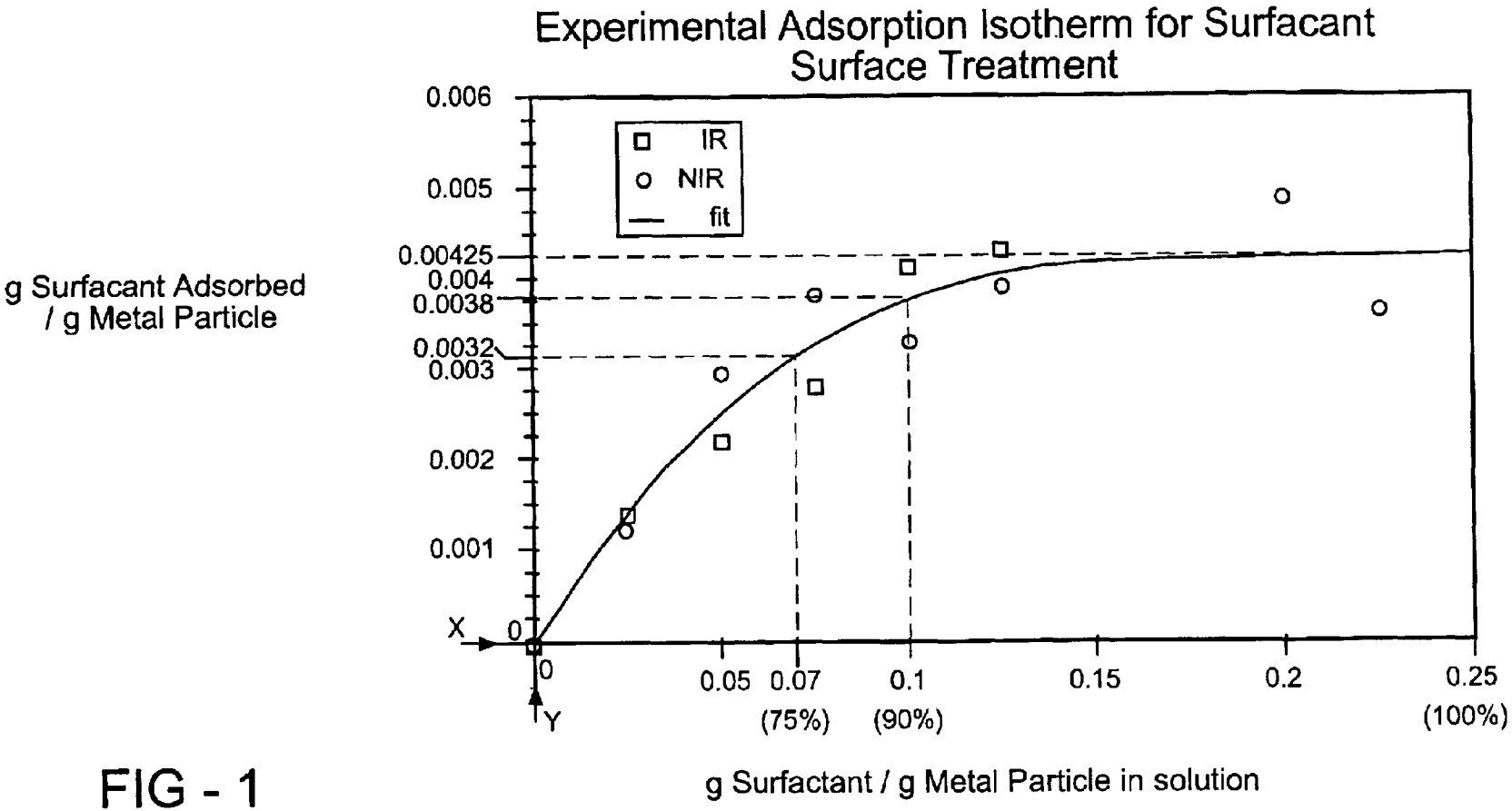
FIG. 1 is a graphical representation of an adsorption isotherm for metal particles being treated with a surfactant.

The subject invention provides a magnetorheological (MR) composition having improved resistance to oxidation and increased dispersability in a carrier fluid. The MR composition is preferably utilized in a magnetorheological (MR) fluid for use in automotive applications, such as in shock absorbers, vibration dampers, force/torque transfer (clutch) devices, and the like, and especially in systems in which variable control of the applied dampening/force is desirable. The MR composition includes a plurality of metal particles and a surfactant.

The metal particles include at least one of iron and iron alloys. Preferably, the metal particles are carbonyl iron, which is formed by the thermal decomposition of iron pentacarbonyl. The iron pentacarbonyl is typically formed from finely divided iron that is treated with carbon monoxide in the presence of a catalyst. The metal particles have a surface with hydroxyls, occuring as for example, but not limited to, $Fe(OH)_x$ and hydrated oxides, such as $Fe_2O_3.nH_2O$ and $Fe_3O_4.nH_2O$. It is to be appreciated that other types of metals, such as iron-cobalt alloys or steel, may be used with the subject invention. In the preferred embodiment, the metal particles are include carbonyl iron, both reduced and unreduced, and water-atomized iron powder. Examples of preferred carbonyl irons include, BASF grades CM, CR, CS, CL, HS, HL, HM, HF and HQ, and International Specialty Products (ISP) grades R-1470, R-2430, S-3700, S-1640 and S-2701. Examples of water-atomized iron powders include Hoeganaes Grade FPI and Grade ATW230 and Quebec Metal Powders Atomet grade powders. An example of a preferred cobalt-iron alloy is Carpenter Technology grade HYPERCO™.

The MR composition also includes the surfactant having a hydrocarbon with at least one of a hydroxyl, a carbonyl, and an amine group bonded to the hydrocarbon for reacting with the metal particles. Preferably, the surfactant includes at least one of ethoxylated amines and propoxylated amines. In the preferred embodiment, the ethoxylated amine is further defined as:

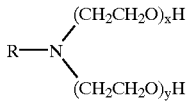

where R is an alkyl group, and the sum of x+y ranges from 2 to 50. An example of a commercially available ethoxylated amine is Ethomeen® T-15 available from Akzo Nobel. For Ethomeen® T-15, x+y=5 and R is a tallowalkyl group. The tallowalkyl group has a carbon chain from 16 to 18 carbon atoms long and is represented by the formula, $C_nH_{2n+1}$. The alkyl groups can be derived from, for example, octadecanoic acid (e.g., Ethomeen® 18/15, from Akzo Nobel, wherein the chemical formula is $C_{18}H_{37}N[(CH_2CH_2O)_xH][CH_2CH_2O)_yH]$, and x+y=5). Propoxylated amines, such as N-tallowalkyl-1,1'-iminobis-2-propanol (e.g., Propomeen® T/12, from Akzo Nobel) and ethoxylated diamines, such as ethoxylated (3) N-tallow-1,3-daiminopropane (e.g., Ethoduomeen® T/13, from Akzo Nobel) are also suitable and are available commercially. The surfactant may include mixtures of any the above commercially available surfactants.

The surfactant also includes at least one of an aliphatic group and a cyclic group bonded to the hydrocarbon for increasing the dispersability of the magnetorheological composition. Preferably, the aliphatic group is further defined as an alkyl group and the cyclic group is further defined as an aryl group. The aliphatic group and the cyclic group increases the dispersability of the metal particles in the carrier fluid.

The surfactant is reactive with the metal particles such that a maximum amount of the surfactant adsorbs to the metal particles. In the preferred embodiment, the hydroxyl, amine, or carboxyl group reacts with the hydroxyl or the oxide group of the metal particle. The surfactant is present in an amount such that from about 1% to about 20% of the amount of the surfactant is adsorbed to the metal particles for improving the resistance of the metal particles to oxidation and for increasing the dispersability of the magnetorheological composition in the carrier fluid. More preferably, about 1% to about 12% of the amount of the surfactant has adsorbed to the metal particles, and more preferably less than 7% of the amount of the surfactant has adsorbed to the metal particles. For example, referring to FIG. 1, if 0.25 grams of surfactant are mixed with 1.00 grams of metal particles, about 0.00425 grams of the surfactant will adsorb to the metal particles. The 0.00425 grams that has adsorbed is 1.7% of the 0.25 grams initially mixed. The surfactant that has not adsorbed would remain in the composition and can be determined with a mass balance as is known in the art. Mixing 0.1 grams of surfactant with 1 gram of metal particles results in about 0.0038 grams of surfactant adsorbing to the metal particles, or about 3.8%. The amount of surfactant and metal particles effects the percentage. Larger metal particles have a larger surface area, which allows for a larger percent of surfactant to adsorb, such as up to 20%.

The surfactant is then adsorbed to the surface of the metal particle such that about 75% to about 100% of the maximum amount of the surfactant adsorbs to the metal particles. The maximum amount is when no more surfactant is able to adsorb to the metal particles. Alternately, the maximum amount is obtained when additional surfactant is added and no more surfactant is able to adsorb to the metal particles. Preferably, the surfactant is reactive with the metal particles such that greater than about 90% of the maximum amount of surfactant adsorbs to the metal particles. The surfactant improves the resistance of the metal particles to oxidation and increases the dispersability of the magnetorheological composition in the carrier fluid.

The maximum amount of surfactant that is adsorbed to the metal particles is graphically illustrated in FIG. 1 as an adsorption isotherm of the reaction between the surfactant and the metal particles. The surfactant is mixed with the metal particles in a weight ratio of from 1:100 to 10:1, preferably from 1:50 to 1:1, and more preferably from 1:20 to 1:4. As shown in FIG. 1, the amount of surfactant per gram of metal particles has a weight ratio of from 0 to 1:4, or from 0 to 0.25 grams surfactant per gram of metal particles. As is the case with any such process, there is a partition of the surfactant between the solution and the liquid/metal particle interface. Infrared (IR) and/or near infrared (NIR) spectroscopy was used to follow the change in solution concentration of the surfactant used to treat the metal particles, or it may be done by other methods known to those of skill in the art.

In the subject invention, the adsorption isotherm was experimentally determined using IR and NIR absorption bands corresponding to water produced in the condensation reaction between the surfactant and the surface hydroxyl groups. A best fit curve was identified to determine the amount of the surfactant that has adsorbed to the metal particles. The x-axis represents the amount of surfactant (grams) added per the amount of metal particles (grams). The y-axis represents the amount of surfactant (grams) that has adsorbed per the amount of metal particles (grams). At 0.05 grams of surfactant added per gram of metal particle, approximately 0.0025 grams of surfactant has reacted, i.e., adsorbed, to the surface of the metal particles. As more grams of surfactant are added per gram of metal particles, the amount of adsorption plateaus, at about 0.00425 grams of adsorbed surfactant per gram of metal particle. The plateau represents the maximum concentration that can be established with the selected surfactant and metal particles.

For FIG. 1, the surfactant was T-15 and the metal particles were carbonyl iron. The T-15 and carbonyl iron were mixed together for 24 hours at 25 degrees C. It is to be understood that varying the amounts of surfactant and metal particles for different time and temperatures produces different adsorption isotherms. Additional tests were conducted at a temperatures of about 40 degrees C. for 4, 8, and 24 hours. Since water is generated in the treatment reaction, the extent of treatment was inferred from NIR analysis of the water content of the post-treatment liquid. The result showed that the extent of treatment decreased at higher temperature. Preferably, the reaction is carried out at an ambient temperature in the range of about 20 degrees C. to about 30 degrees C. for a period of greater than about 6 hours, and more preferably treated at a temperature of about 23 degrees C. to about 27 degrees C. for 8 to 12 hours.

Accordingly, the surfactant and the metal particles are reacted until about 75% to about 100% of the maximum concentration is reached. At 0.1 grams of Ethomeen® T-15 per gram of carbonyl iron, about 0.0038 grams of Ethomeen® T-15 has adsorbed to the each gram of carbonyl iron, which is about 90% of the maximum concentration. Since, the maximum concentration was determined to be 0.00425 grams adsorbed surfactant per gram of metal particles, 75% of the maximum corresponds to about 0.0032 grams adsorbed surfactant per gram of metal particles. The 75% of the maximum concentration is achieved by initially mixing 0.07 grams of surfactant per gram of metal particles.

Non-adsorbed surfactant remains in the mixture and must be removed with a washing media. The non-adsorbed surfactant is removed to ensure that the fumed silica will be able to suspend the iron particles. After the maximum amount of surfactant has adsorbed, the non-adsorbed surfactant is present. Preferably, the non-adsorbed surfactant is present in an amount less than about 5% by weight based on 100 parts by weight of the magnetorheological composition. Even more preferably, the non-adsorbed surfactant is present in an amount less than about 2% by weight based on 100 parts by weight of the magnetorheological composition. The washing media may be selected from a low viscosity synthetic hydrocarbon or a chemically equivalent substance. The preferred washing media is a polyalphaolefin (PAO) based on 1-decene or 1-dodecene. Examples of commercially available PAO includes: SHF 21 (available from Exxon-Mobil Corp.), which is primarily the dimer of 1-decene, SHF 41 (also available from Exxon-Mobil), which is a mixture of trimer and tetramer of 1-decene, and the dimer of 1-dodecene (available from Chevron-Phillips Corp.). In each case, the chemical nature of the liquid promotes surfactant solubility, and the low viscosity allows efficient post-treatment wash to remove excess surfactant.

The subject invention further includes a method of preparing the magnetorheological composition. The method includes the step of reacting the metal particles with the surfactant until about 75% to about 100% of the maximum amount of the surfactant adsorbs to the metal particles. In the preferred embodiment, the step of reacting is further defined as reacting the metal particles with the surfactant until greater than about 90% of the maximum amount of the surfactant adsorbs to the metal particles. The step of reacting is further defined as mixing an amount of the surfactant and an amount of the metal particles in a weight ratio of from 1:100 to 10:1, preferably from 1:50 to 1:1, and more preferably from 1:20 to 1:4.

In order to determine the maximum concentration for the specific metal particle and surfactant, the reaction of the surfactant with the metal particles is monitored to determine an amount of the surfactant that has adsorbed to the metal particles. Next, the amount of the surfactant is modified, while the amount of the metal particles is maintained. They are remixed and the amount adsorbed is determined and graphically plotted. Modifying the amount of the surfactant is continued until the maximum concentration is achieved as described above.

Figure 2:
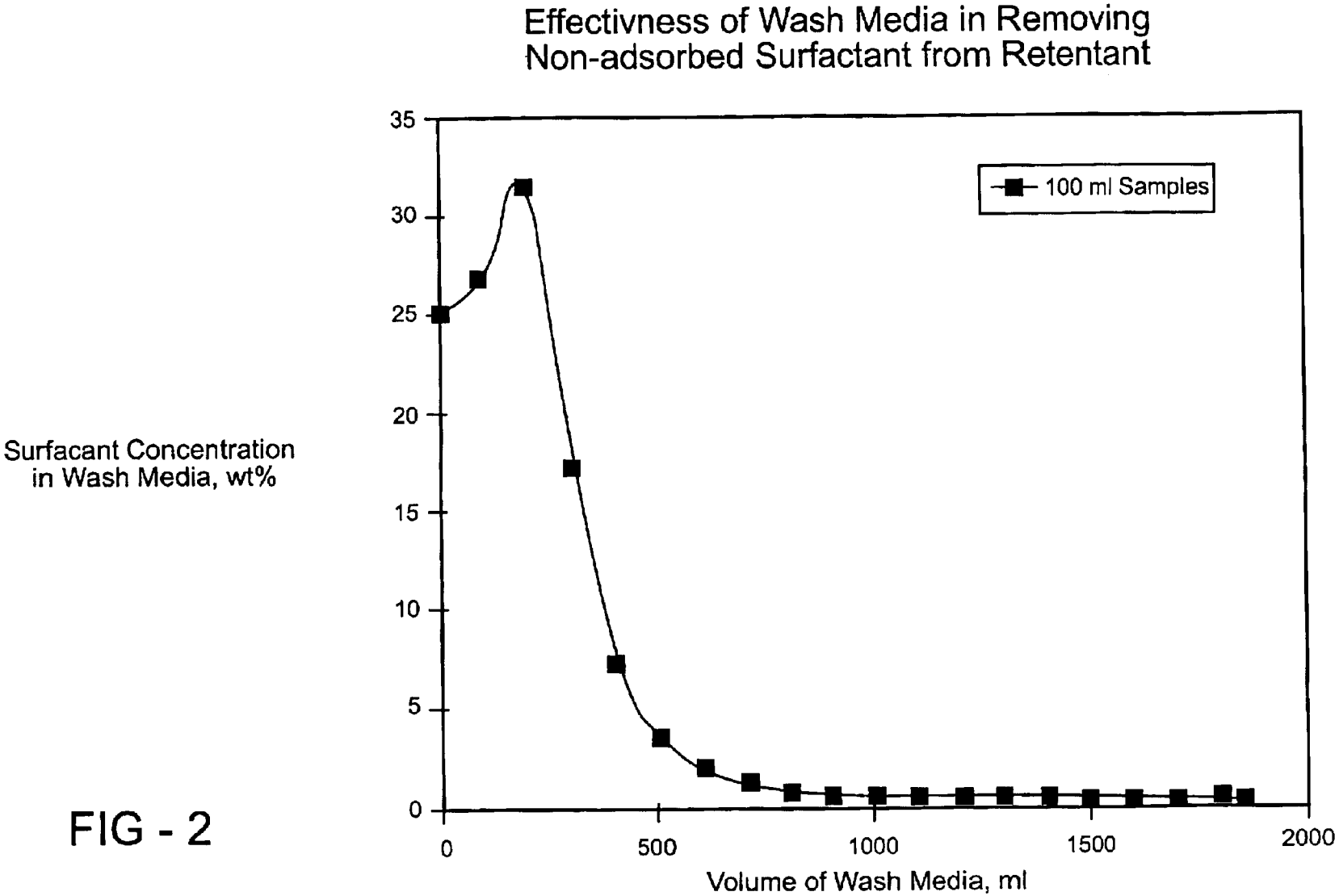
FIG. 2 is a graphical representation of a non-adsorbed surfactant being present in a retentate while being washed with a washing medium to remove the non-adsorbed surfactant from the retentate.

After the reaction has reached the desired point, the mixture is filtered to form a retentate. The filtering is accomplished using standard methods known to those skilled in the art. Next, any non-adsorbed surfactant is removed from the retentate. In the preferred embodiment, the retentate is washed with the washing media. With reference to FIG. 2, a graphical representation of the removal of the non-adsorbed surfactant is illustrated. The x-axis represents the amount of wash media used to wash the retentate and the y-axis represents the amount of non-adsorbed surfactant in the wash media. Each point on the graph represents an additional 100-ml of wash media poured through the retentate. The amount of non-adsorbed surfactant present in the wash media indicates that less non-adsorbed surfactant is present in the retentate to those skilled in the art.

The concentration of the non-adsorbed surfactant is monitored in the washing media and the retentate is continuously washed until the concentration of the non-adsorbed surfactant in the washing media is less than about 5% by weight based on 100 parts of the retentate. The step of continuing to wash the retentate is further defined as continuing to wash the retentate until the concentration of the non-adsorbed surfactant in the washing media is less than about 2% by weight based on 100 parts of the retentate. The amount of washing media used should be sufficient to remove at least 90% of all non-adsorbed surfactant from the retentate, preferably greater than about 95% and most preferably greater than about 98%. The amount of non-adsorbed surfactant depends upon the amount and times the retentate is washed with washing media. Preferably, after washing, the non-adsorbed surfactant should be less than 2% by weight of the non-adsorbed surfactant based on 100 parts of the retentate.

For example, a 1300-gram sample of the retentate having carbonyl iron coated with Ethomeen® T-15 was effectively washed with 600 grams of PAO. The PAO was added in two washing of 300 grams each for reducing the level of non-adsorbed Ethomeen® T-15 to less than about 2% The concentration of the Ethomeen® T-15 in the washing media, i.e, PAO, is the same as that which remains in the retentate. If the concentration in the wash fluid is 2%, then 2% or less must remain in the coated carbonyl iron. It is to be appreciated by one skilled in the art, that varying the amount of washing media removes more non-adsorbed surfactant.

Figure 3:
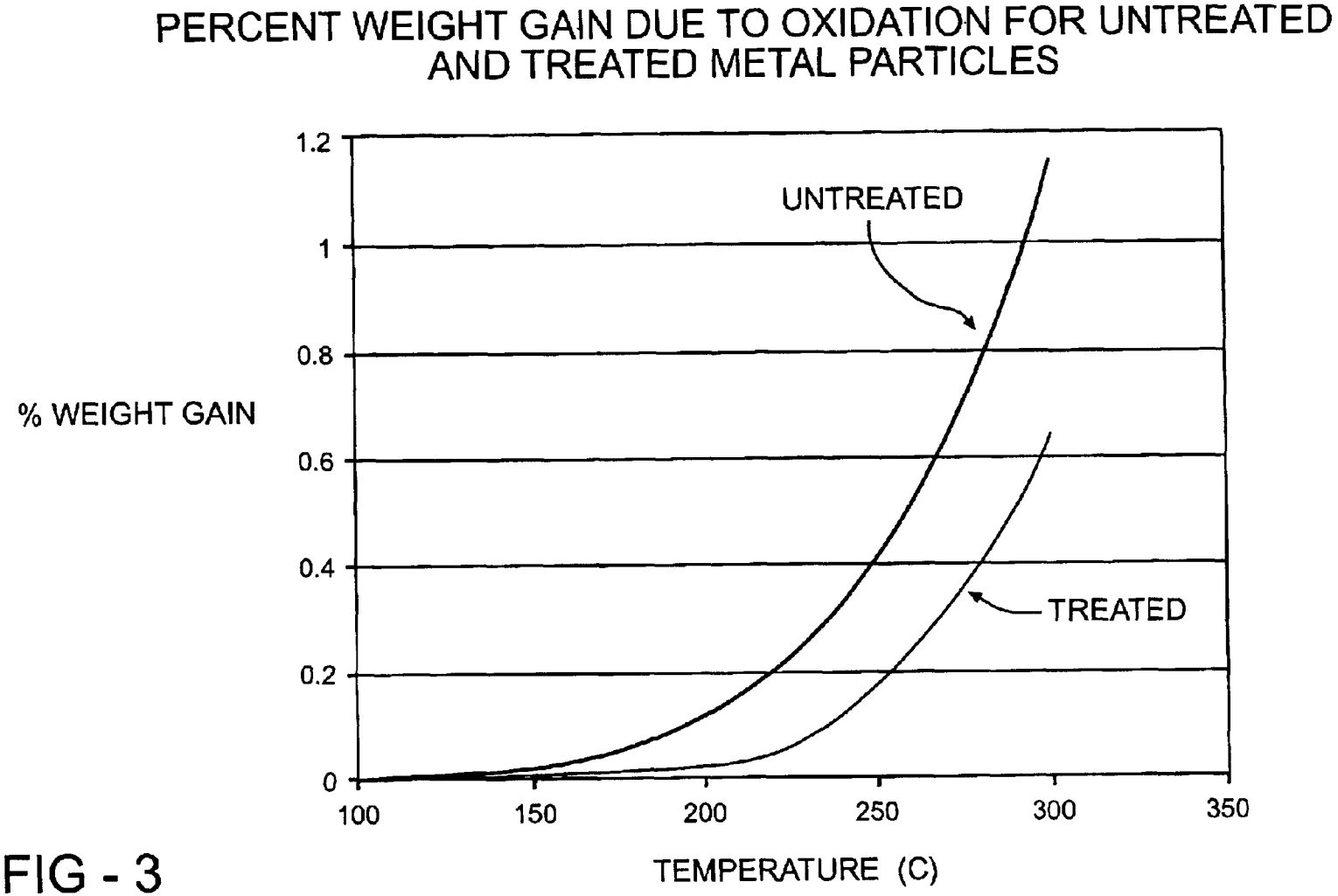
FIG. 3 is a graphical representation of differences in the oxidation for metal particles treated according to the present invention and untreated samples.

The retentate after being surface treated retards oxidation, as illustrated in FIG. 3. The steeper curve shows the weight gain of an "untreated" sample of metal particles due to formation of oxidation products in a controlled heating rate thermogravimetric analysis (TGA) test. The "untreated" sample is carbonyl iron with a mean diameter of about 8 microns. In its virgin state, each particle has a thin oxide layer which forms in normal processing. It does not have any passivating effect, so that in an oxygen atmosphere the particles oxidize at a rate dictated solely by the temperature, the specific surface area, and the oxidation potential of the iron itself. A sample of the same type of carbonyl iron "treated" according to the present invention having 90% of the maximum concentration of T-15 adsorbed to the carbonyl iron has a shallower curve.

Figure 4:
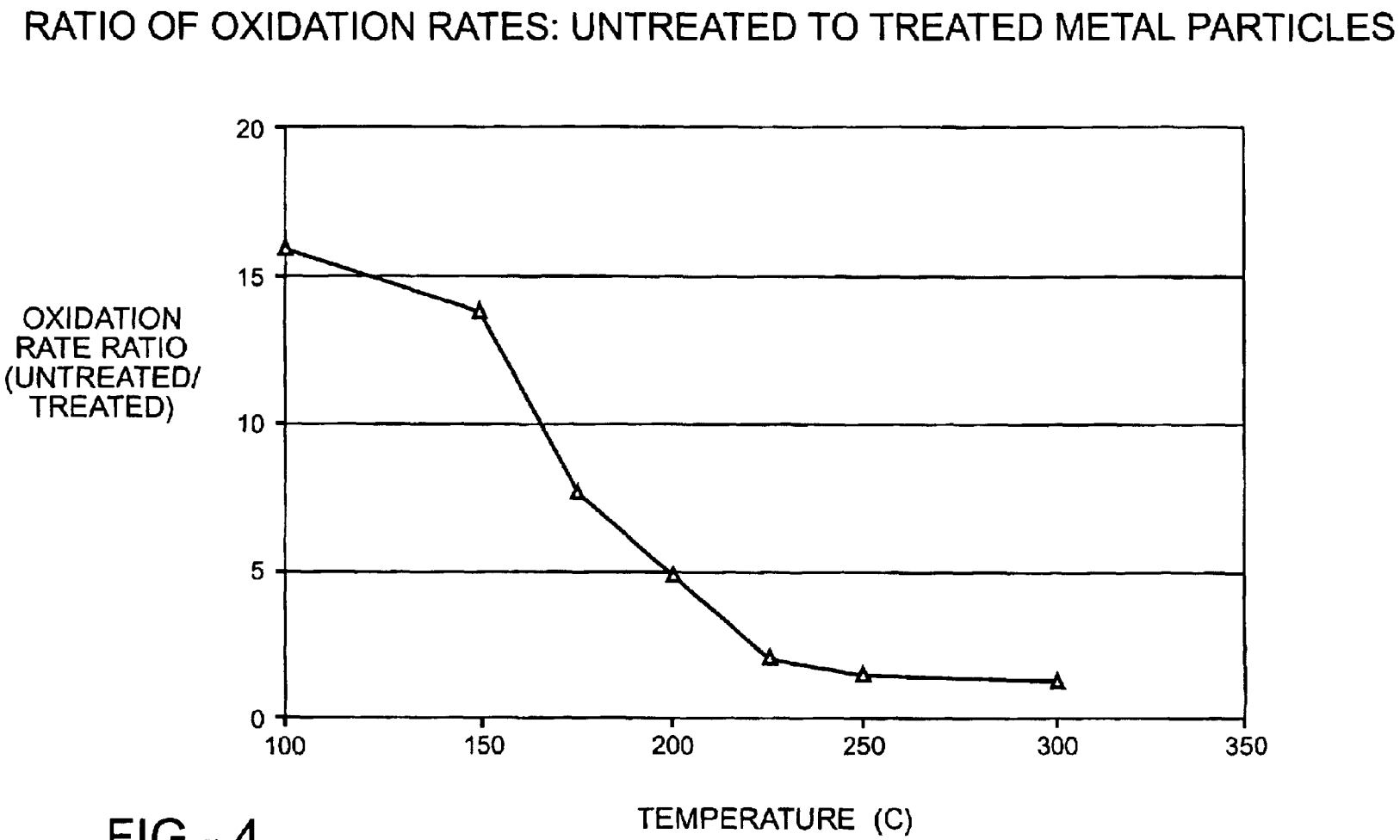
FIG. 4 is a graphical representation of the ratio of the rate of oxidation of the untreated to treated metal particles of FIG. 3.

The ratio of oxidation rates for "untreated"/"treated" carbonyl iron is shown as a function of temperature in FIG. 4. As shown, the oxidation rate of untreated carbonyl iron is about 15 times higher than the same treated material for typical maximum fluid surface temperatures found in MR fluid shock absorbers (i.e., about 100 degrees C. to about 110 degrees C.) and about 2 to 5 times higher for typical MR fluid clutch applications under high torque conditions where the clutch is in the slip mode (i.e., temperatures of about 200 degrees C. to 250 degrees C.).

The MR composition is to be combined with other additives to form a MR fluid. The MR fluid includes the carrier fluid. Preferably, the washing media is chemically compatible with the carrier fluid. The carrier fluid includes a hydrocarbon and is preferably a polyalphaolefin carrier fluid. However, it is to be appreciated that the carrier fluid may be a polymeric medium or an elastomeric meduim depending upon the type of application of the MR fluid.

Even more preferably, the carrier fluid includes at least one of 1-decene and 1-dodecene. The carrier fluid of the present invention comprises a polyalphaolefin (PAO) and a plasticizer. Preferred PAO's include dimers and trimers of decene and dodecene, such as Chevron-Phillips Synfluid™ 2.5 (a dimer of 1-dodecene), Chevron-Phillips Synfluid™ 2 (a dimer of decene), Chevron-Phillips Synfluid™ 4 (a trimer of decene), Exxon-Mobil PAO SHF 21 (a dimer of decene), Exxon-Mobil PAO SHF 41 (a trimer of decene) and Amoco Durasyn™ 170. Preferably, the polyalphaolefin is selected from the group consisting of dimers and trimers of decene, dimers and trimers of dodecene, and mixtures thereof. Even more preferably, the carrier fluid consists essentially of a mixture of a dimer of 1-dodecene and dioctyl sebacate in a volume ratio of about 4:1.

The MR fluid may also include a thickener for suspending the magnetorheological composition in the carrier fluid. The thickener may be a fumed silica or an organoclay depending upon the application. The non-adsorbed surfactant is preferably present in an amount less than about 5% by weight based on 100 parts of the thickener. The preferred thickener is untreated fumed silica that is produced by the vapor phase hydrolysis of silicon tetrachloride in a hydrogen oxygen flame. Examples of commercially available fumed silicas include CAB-O-SIL® grades EH-5, HS-5, H-5 and MS-55, available from Cabot Corporation.

The MR fluid may also include other anti-wear and anti-friction agents. Examples of anti-wear agents include zinc dialkyl dithiophosphate (ZDDP) such as available from Lubrizol Corporation (e.g., grades 1395 and 677A) and Ethyl Corporation (e.g., grades HiTEC™ 7197 and HiTEC™ 680). Examples of anti-friction agents include organomolybdenums (MOLY) such as NAUGALUBE™ MOLYFM 2543 available from C.K. Witco and MOLYVAN™ 855, MOLYVAN™ 822, and VANLUBE™ 7723 available from R.T. Vanderbilt Company and alkyl amine oleates.

Another application that utilizes the MR composition is a MR elastomer. In manufacturing MR elastomers, the MR composition is combined with a rubber precursor, i.e., which is equivalent to the carrier fluid for the MR fluid. The rubber precursor can be either liquid, such silicone rubbers, or paste-like, such as natural rubber. Once the MR composition is incorporated into the rubber precursor, the mixture is cured in the presence of a magnetic field to ensure that the metal particles are aligned in the direction of the magnetic field within the elastomeric matrix. The alignment of the metal particles within the elastomeric matrix provides the MR elastomer with non-isotropic properties in both the off-state and in the on-state when a magnetic field is applied. A large magnetic effect is obtained when the applied magnetic field is aligned with the embedded metal particles, and the stiffness and damping properties of the MR elastomer are also influenced by the particle alignment. This alignment of the magnetic particles can be leveraged to obtain MR elastomers with low off-state stiffness and high on-state stiffness, thus providing a large turn-up ratio.

The surfactant, for the elastomeric matrix, is chosen to minimize interaction between the magnetic particles and the elastomeric matrix. Thus, by avoiding chemical incorporation of the metal particles into the matrix, the off-state stiffness of the MR elastomer is somewhat reduced. The surfactant provides another important function in that it prevents the metal particles from "poisoning" the catalyst used in the rubber curing process. If the catalyst is poisoned, the elastomer is prevented from achieving optimal cure. The surfactant effectively blocks the iron particles from interacting with the catalyst, thereby allowing the cure to proceed unimpeded.

Obviously, many modifications and variations of the present invention are possible in light of the above teachings. The invention may be practiced otherwise than as specifically described within the scope of the appended claims. The invention has been described in an illustrative manner, and it is to be understood that the terminology, which has been used, is intended to be in the nature of words of description rather than of limitation.

What is claimed is:

1. A magnetorheological composition having improved resistance to oxidation and increased dispersability in a carrier fluid, said composition comprising:

a plurality of metal particles;

a surfactant comprising a hydrocarbon with at least one of a hydroxyl, a carbonyl, and an amine group bonded to said hydrocarbon for reacting with said metal particles; and said surfactant being present in an amount of from 1:100 to 10:1 based on a weight ratio of said surfactant to said metal particles such that said surfactant adsorbs to said metal particles for improving the resistance of said metal particles to oxidation and for increasing the dispersability of said magnetorheological composition in the carrier fluid.

2. A magnetorheological composition as set forth in claim 1 wherein said amount of said surfactant is further defined as a weight ratio of said surfactant to said metal particles is from 1:50 to 1:1.

3. A magnetorheological composition as set forth in claim 1 wherein said amount of said surfactant is further defined as a weight ratio of said surfactant to said metal particles is from 1:20 to 1:4.

4. A magnetorheological composition as set forth in claim 1 wherein said metal particles comprise at least one of hydroxyls and oxides on a surface of said metal particles that react with at least one of said hydroxyl, carbonyl, and amine group.

5. A magnetorheological composition as set forth in claim 4 wherein said hydrocarbon includes at least one of an aliphatic group and a cyclic group for increasing the dispersability of said magnetorheological composition.

6. A magnetorheological composition as set forth in claim 5 wherein said aliphatic group is further defined as an alkyl group.

7. A magnetorheological composition as set forth in claim 5 wherein said cyclic group is further defined as an aryl group.

8. A magnetorheological composition as set forth in claim 1 wherein said surfactant comprises at least one of ethoxylated amines and propoxylated amines.

9. A magnetorheological composition as set forth in claim 1 wherein said surfactant is further defined as:

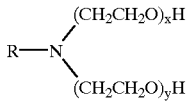

where R is an alkyl group, and the sum of x+y ranges from 2 to 50.

10. A magnetorheological composition as set forth in claim 1 wherein said metal particles comprises at least one of iron and iron alloys.

11. A magnetorheological composition as set forth in claim 10 wherein said metal particles comprise carbonyl iron.

12. A method of preparing a magnetorheological composition comprising a plurality of metal particles and a surfactant having a hydrocarbon chain with at least one of a hydroxyl, a carbonyl, and an amine group bonded to said hydrocarbon for reacting with the metal particles such that the magnetorheological composition has improved resistance to oxidation and increased dispersability in a carrier fluid, said method comprising the step of:

reacting the metal particles with the surfactant until about 75% to about 100% of a maximum amount of the surfactant adsorbs to the metal particles.

13. A method as set forth in claim 12 further comprising the step of filtering the metal particles to form a retentate after the metal particles have been reacted with the surfactant.

14. A method as set forth in claim 13 further comprising the step of removing any surfactant that has not adsorbed to the metal particles.

15. A method as set forth in claim 14 wherein the step of removing is further defined as washing the retentate with a washing media to remove any surfactant that has not adsorbed to the metal particles.

16. A method as set forth in claim 15 further comprising the steps of monitoring a concentration of the non-adsorbed surfactant in the washing media and continuing to wash the retentate until the concentration of the non-adsorbed surfactant in the washing media is less than about 5% by weight based on 100 parts of the retentate.

17. A method as set forth in claim 16 wherein the step of continuing to wash the retentate is further defined as continuing to wash the retentate until the concentration of the non-adsorbed surfactant in the washing media is less than about 2% by weight based on 100 parts of the retentate.

18. A method as set forth in claim 14 wherein the step of washing the retentate with the washing media is further defined as washing the retentate with a washing media being chemically compatible with the carrier fluid.

19. A method as set forth in claim 12 wherein the step of reacting is further defined as reacting the metal particles with the surfactant until greater than about 90% of the maximum amount of the surfactant adsorbs to the metal particles.

20. A method as set forth in claim 12 wherein the step of reacting is further defined as mixing an amount of the surfactant with the metal particles in a ratio of from 1:100 to 10:1.

21. A method as set forth in claim 12 wherein the step of reacting is further defined as mixing an amount of the surfactant with the metal particles in a ratio of from 1:50 to 1:1.

22. A method as set forth in claim 12 wherein the step of reacting is further defined as mixing an amount of the surfactant with the metal particles in a ratio of from 1:20 to 1:4.

23. A method as set forth in claim 20 further comprising the step of monitoring the reaction of the surfactant with the metal particles to determine an amount of the surfactant that has adsorbed to the metal particles.

24. A method as set forth in claim 23 further including the step of modifying the amount of the surfactant and maintaining the amount of the metal particles and remixing the surfactant and the metal particles.

25. A method as set forth in claim 24 further comprising the step of continuing to modify the amount of the surfactant and remixing until the maximum amount of the surfactant is reached.

26. A magnetorheological fluid having improved stability, said fluid comprising:

a carrier fluid comprising a hydrocarbon; and a magnetorheological composition dispersed in said carrier fluid, said magnetorheological composition comprising;

a plurality of metal particles, a surfactant comprising a hydrocarbon with at least one of an aliphatic group and a cyclic group, and said surfactant being present in an amount of from 1:100 to 10:1 based on a weight ratio of said surfactant to said metal particles such that said surfactant adsorbs to said metal particles for improving the resistance of said metal particles to oxidation and for increasing the dispersability of said magnetorheological composition in the carrier fluid.

27. A magnetorheological composition as set forth in claim 26 wherein said amount is further defined as a weight ratio of said surfactant to said metal particles of from 1:50 to 1:1.

28. A magnetorheological composition as set forth in claim 26 wherein said amount is further defined as a weight ratio of said surfactant to said metal particles of from 1:20 to 1:4.

29. A magnetorheological fluid as set forth in claim 26 wherein each of said metal particles comprise at least one of hydroxyls and oxides on a surface of said metal particles.

30. A magnetorheological fluid as set forth in claim 29 wherein said surfactant comprises at least one of a hydroxyl, a carbonyl, and an amine group bonded to said hydrocarbon for reacting with at least one of said hydroxyls and said oxides covering said surface of said metal particles.

31. A magnetorheological fluid as set forth in claim 26 wherein said metal particles comprises at least one of iron and iron alloys.

32. A magnetorheological fluid as set forth in claim 31 wherein said metal particles comprise carbonyl iron.

33. A magnetorheological fluid as set forth in claim 26 wherein said carrier fluid comprises a polyalphaolefin carrier fluid.

34. A magnetorheological fluid as set forth in claim 26 wherein said carrier fluid comprises a polymeric medium.

35. A magnetorheological fluid as set forth in claim 26 wherein said carrier fluid comprises an elastomeric medium.

36. A magnetorheological fluid as set forth in claim 26 wherein said carrier fluid comprises at least one of 1-decene and 1-dodecene.

37. A magnetorheological fluid as set forth in claim 26 further comprises a thickener for suspending said magnetorheological composition in said carrier fluid.

38. A magnetorheological fluid as set forth in claim 37 wherein said thickener comprises fumed silica.

39. A magnetorheological fluid as set forth in claim 37 wherein said thickener comprises an organoclay.

40. A magnetorheological elastomer having improved magnetic response, said fluid comprising:

a rubber precursor; and a magnetorheological composition dispersed in said rubber precursor, said magnetorheological composition comprising;

a plurality of metal particles, a surfactant comprising a hydrocarbon with at least one of an aliphatic group and a cyclic group, and said surfactant being present in an amount such that of from about 1% to about 20% of said amount of said surfactant is adsorbed to said metal particles for improving the resistance of said metal particles to oxidation and for increasing the dispersability of said magnetorheological composition in the carrier fluid.

41. A magnetorheological elastomer as set forth in claim 40 wherein said amount is further defined as a weight ratio of said surfactant to said metal particles of from 1:100 to 10:1.

42. A magnetorheological composition as set forth in claim 40 wherein said amount is further defined as a weight ratio of said surfactant to said metal particles of from 1:50 to 1:1.

43. A magnetorheological composition as set forth in claim 40 wherein said amount is further defined as a weight ratio of said surfactant to said metal particles of from 1:20 to 1:4.

44. A magnetorheological elastomer as set forth in claim 40 wherein said rubber precursor comprises at least one of natural rubber and silicone rubbers.

* * * * *